United States Patent [19]

Hintsch

[11] 4,321,951

[45] Mar. 30, 1982

[54] WARP YARN STOP MOTION

[75] Inventor: Otto Hintsch, Wallisellen, Switzerland

[73] Assignee: Sulzer Brothers Ltd., Winterthur, Switzerland

[21] Appl. No.: 133,393

[22] Filed: Mar. 24, 1980

[30] Foreign Application Priority Data

Apr. 25, 1979 [CH] Switzerland ..... 3887/79

[51] Int. Cl.[3] ..... D03D 51/28

[52] U.S. Cl. ..... 139/353; 66/163

[58] Field of Search ..... 139/353, 359, 368, 369; 66/163; 200/61.18

[56] References Cited

U.S. PATENT DOCUMENTS

| | | | |
|---|---|---|---|
| 2,432,953 | 12/1947 | Vossen | 66/163 |
| 2,531,944 | 11/1950 | Metcalf | 139/353 |
| 3,246,091 | 4/1966 | Koch | 139/353 |
| 3,907,006 | 9/1975 | Pfarrwaller | 139/353 |

*Primary Examiner*—Henry Jaudon

*Attorney, Agent, or Firm*—Kenyon & Kenyon

[57] ABSTRACT

The warp yarn stop motion is provided with a locating rail which is sub-divided into electrically insulated sections from the U-shaped rail. Each of these sections is electrically connected with pilot lights at the ends of each section. Should a drop wire fall on to a rail section, the pilot lights at the ends of the section are also illuminated so as to define the segment of the weaving width within which a broken warp yarn is located.

10 Claims, 2 Drawing Figures

WARP YARN STOP MOTION

Figure 1:
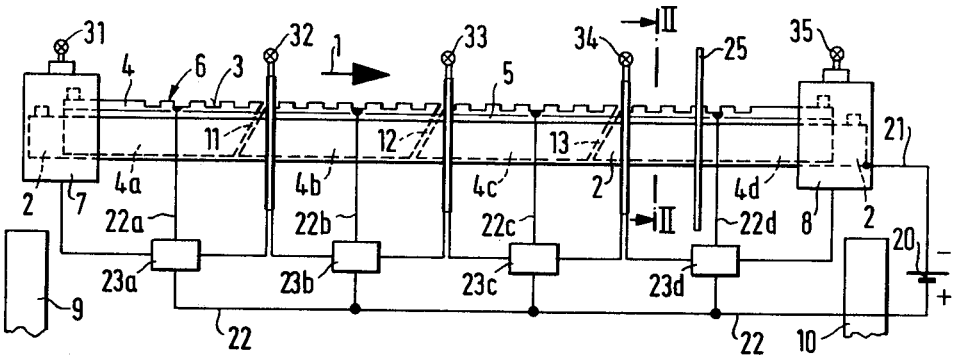

This invention relates to a warp yarn stop motion and, more particularly, to a warp yarn stop motion for a weaving machine.

As is known, various types of warp yarn stop motions have been used in weaving machines in order to detect warp yarn breaks during weaving. Stop motions of this type are described in U.S. Pat. Nos. 3,584,659 and 3,907,006. Generally, these stop motions have two metal elements in the form of rails connected to a power supply and extending in the direction of a weft yarn over the warp yarns being processed in the weaving machine. In addition, drop wires are threaded over the rails and are supported on the warp yarns. Should a warp yarn break, the respective drop wire falls under gravity onto the rails so as to short-circuit the rails, and, thus, complete an electrical connection for stopping the weaving machine.

Generally, one rail of the stop motion is of U-shaped cross section while the other rail is located within the U-shaped rail in an electrically insulated manner and projects from the U-shaped rail with a serration along the top edge. In addition, both rails extend continuously over the entire cloth width of the weaving machine. Consequently, during actuation of the stop motion by a yarn break, it becomes difficult to determine which of the numerous warp yarns has broken. For example, in order to detect which of the drop wires has dropped as a result of the yarn breakage, an operator has to run his hand over all the drop wires. After some experimentation, it is possible to determine which one of the numerous drop wires cannot be pushed aside in the same way as the remainder of the wires. This wire is the wire belonging to the broken warp yarn. However, it is especially difficult for an inexperienced operator to carry out this locating process.

Accordingly, it is an object of the invention to reduce the time required to locate a broken warp yarn in a weaving machine.

It is another object of the invention to provide a stop motion of relatively simple construction for locating warp yarn breaks.

Briefly, the invention provides a warp yarn stop motion which is comprised of a pair of metal rails at least one of which is subdivided into at least two electrically insulated sections, a power supply connected to the rails and a plurality of signalling means each of which is electrically connected to a respective insulated section. The stop motion also has a plurality of drop wires mounted over the rails with each drop wire having at least a pair of surfaces for contacting the respective rails to complete an electrical circuit therewith.

The signalling means are disposed so as to emit a visual signal in response to a drop wire contacting the rails associated with a respective insulated section. For example, with each signalling means in the form of a pilot light mounted on the respective end of a respective insulated section, completion of a circuit across an insulated section and associated rail causes the pilot lights at the ends of the insulated section to illuminate. Thus, the lights determine the section within which a drop wire has descended. An operator can then more readily determine the actual position of the drop wire and the broken yarn and can re-tie the broken warp yarn.

Figure 2:
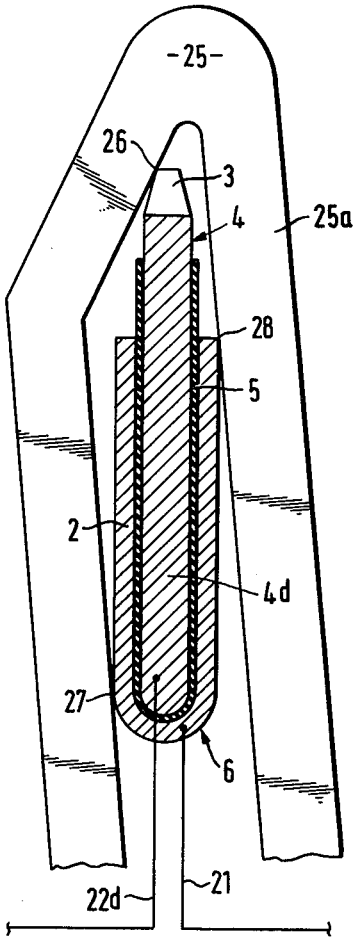

These and other objects and advantages of the invention will become more apparent from the following detailed description taken in conjunction with the accompanying drawings wherein:

FIG. 1 illustrates a diagrammatic view of a warp yarn stop motion for a weaving machine constructed in accordance with the invention; and FIG. 2 illustrates a view taken on line II—II of FIG. 1.

Referring to FIG. 1, the warp yarn stop motion includes a contact rail 6 which is mounted in a pair of holders 7, 8, on a weaving machine. As indicated, the holders 7, 8, are situated near the two sides 9, 10, of the weaving machine.

Each contact rail 6 is comprised of a pair of metal rails 2, 4, which extend in the direction of the weft, as indicated by the arrow 1, transversely above the warp yarns (not shown) being processed in the weaving machine.

Referring to FIG. 2, the contact rail 6 includes a substantially rectilinear supporting rail 2 of U-shaped cross section and a second locating rail 4 which is subdivided into sections 4*a*, 4*b*, 4*c*, 4*d*. This locating rail 4 is longitudinally inserted into the U-shaped rail 2 and electrical insulation 5 is provided between the two rails 2, 4. Further the locating rail 4 has a serration 3 along the top edge. The respective electrically insulated sections 4*a*–4*d* are separated by gaps 11, 12, 13, whereas the rail 2 and insulation 5 extend continuously between the holders 7, 8.

Referring to FIG. 1, the warp yarn stop motion also has an electrical circuit connected with the rails 2, 4. This circuit includes a power supply 20, a line 21 connected to the negative terminal (earth) of the power supply 20 and to the sub-divided sections 4*a*–4*d* in parallel, and a second line 22 which is connected to the power supply and a plurality of distribution points 23*a*, 23*b*, 23*c*, 23*d* in parallel. Each distribution point 23*a*–23*d* is electrically connected to a respective insulated section 4*a*–4*d* and to a pair of signalling means 31, 32, 33, 34, 35. As shown, each of the signalling means is disposed at one end of a respective insulated section 4*a*–4*d* and is in the form of a pilot light for emitting a visual signal. The pilot lights 31–35 are actuated in pairs in response to a respective insulated section 4*a*–4*d* adjacent a respective light 31–35 becoming electrically connected to the rail 2.

Referring to FIG. 2, a plurality of drop wires 25 are mounted over the contact rail 6 in conventional fashion. To this end, each drop wire 25 has at least a pair of surfaces for contacting the respective rails 2, 4 to complete an electrical circuit therewith. As indicated, each drop wire 25 has an aperture with a pair of parallel side walls and a sloped upper wall. The aperture serves to permit threading of the drop wire 25 over the contact rail 6. Each drop wire 25 also has a suitable surface (not shown) to be supported on a warp yarn (not shown). In this regard, the drop wire 25 is supported so that the sloped upper wall surface is disposed above the contact rail 6.

During operation, should a warp yarn break, the associated drop wire 25 will fall under gravity onto the serrated edge 3 of the contact rail 6. For example, in the position 25*a* shown in FIG. 2, should the drop wire 25 fall onto the insulated section 4*d*, the drop wire 25 tilts due to the sloped wall surface coming into contact with the rail section 4*d* to form an electrical connection between the section 4*d* and the rail 2 via the points 26, 27, 28. Thus, the two pilot lights 34, 35 associated with the rail section 4*d* become illuminated via the distribution point 23*d*. In similar manner, if a wire 25 drops in section 4*a*, the two associated pilot lights 31, 32 become illuminated. If a drop wire drops in the section 4*b*, the lights 32, 33 are illuminated and in section 4*c*, the lights 33, 34 become illuminated.

Whichever pair of lights 31–35 become illuminated, the associated warp yarn breakage is indicated in the associated section 4*a*–4*d* so that the broken yarn can readily be detected and repaired.

It is to be noted that U-shaped rail 2 may also be sub-divided into a plurality of electrically insulated sections in addition to the locating rail 4. Further, the rails 2, 4 may be divided into any number of sections, for example 4 or 5 sections depending upon the cloth width of the weaving machine. In this case, a corresponding number of pilot lights would also be associated with the sub-divided rails.

It is also noted that when a drop wire 25 falls onto the contact rail 6, an electrical signal is also generated for stopping the weaving machine. This is well known and need not be further described.

I claim:

1. In a warp yarn stop motion, the combination of:

a first substantially rectilinear supporting rail;

a second locating rail mounted on said first rail in electrically insulated manner, said rail being sub-divided into at least two electrically insulated sections;

a plurality of drop wires mounted over said rails, each said drop wire having at least a pair of surfaces for contacting said respective rails to complete an electrical circuit therewith; and a plurality of signalling means, each said signalling means being electrically connected to a respective insulated section.

2. A warp yarn stop motion as set forth in claim 1 wherein said second rail is serrated and said first rail is of U-shaped cross-section with said serrated rail disposed therein in electrically insulated manner and projecting from said U-shaped rail.

3. A warp yarn stop motion as set forth in claim 1 wherein each said signalling means is a pilot light mounted on a respective end of a respective insulated section.

4. A warp yarn stop motion as set forth in claim 1 wherein said signalling means of a respective insulated section emits a visual signal in response to a drop wire contacting said first rail and said respective insulated section.

5. A warp yarn stop motion as set forth in claim 1 which further comprises an electrical circuit having a power supply, a first llne connecting said sub-divided sections in parallel to said power supply, a second line connected to said power supply, a plurality of distribution points connected in parallel to said second line, each said distribution point being connected to a respective insulated section and to a pair of said signalling means, said pair of signalling means being disposed at opposite ends of said respective, insulated section.

6. A warp yarn stop motion comprising:

a first substantially rectilinear supporting rail;

a second rail mounted on said first rail in electrically insulated manner, said rail being sub-divided into at least two electrically insulated sections; and a plurality of visual signalling means, each signalling means being mounted at an end of a respective insulating section for emitting a visual signal in response to said first rail and a respective insulated section of said second rail adjacent said respective signalling means becoming electrically connected to each other.

7. A warp yarn stop motion as set forth in claim 6 wherein each said signalling means is a light and wherein two lights associated with a respective insulated section are illuminated in response to said respective insulated section being electrically connected to said first rail to indicate a broken yarn therebetween.

8. A warp yarn stop motion as set forth in claim 6 wherein said first rail is of U-shaped cross-section and has said second rail mounted therein in projecting manner.

9. A warp yarn stop motion as set forth in claim 8 wherein said second rail is serrated along a projecting surface.

10. In a warp yarn stop motion, the combination of a first rail;

a second rail mounted on said first rail in electrically insulated manner, said rail being sub-divided into at least two electrically insulated sections;

a plurality of drop wires mounted over said rails, each said drop wire having at least a pair of surfaces for contacting said respective rails to complete an electrical circuit therewith;

a plurality of signalling means, each said signalling means being electrically connected to a respective insulated section; and an electrical circuit having a power supply, a first line connecting said sub-divided sections in parallel to said power supply, a second line connected to said power supply, a plurality of distribution points connected in parallel to said second line, each said distribution point being connected to a respective insulated section and to a pair of said signalling means, said pair of signalling means being disposed at opposite ends of said respective insulated section.

* * * * *

UNITED STATES PATENT AND TRADEMARK OFFICE

CERTIFICATE OF CORRECTION

PATENT NO. : 4,321,951

DATED : March 30, 1982

INVENTOR(S) : Otto Hintsch

It is certified that error appears in the above—identified patent and that said Letters Patent is hereby corrected as shown below:

Column 3, line 52 change "llne" to --line--.

Signed and Sealed this

*Third* Day of *August 1982*

[SEAL]

*Attest:*

GERALD J. MOSSINGHOFF

*Attesting Officer* *Commissioner of Patents and Trademarks*